US009732707B1

(12) United States Patent
Urban

(10) Patent No.: US 9,732,707 B1
(45) Date of Patent: Aug. 15, 2017

(54) VENT FOR ENGINE CRANKCASES

(71) Applicant: High Output Technology, LLC, Clayton, NC (US)

(72) Inventor: Kurt Urban, Clayton, NC (US)

(73) Assignee: High Output Technology, LLC, Clayton, NC (US)

( * ) Notice: Subject to any disclaimer, the term of this patent is extended or adjusted under 35 U.S.C. 154(b) by 417 days.

(21) Appl. No.: 14/100,938

(22) Filed: Dec. 9, 2013

(51) Int. Cl.
*F01M 13/00* (2006.01)
*F02M 25/08* (2006.01)
*F01M 13/02* (2006.01)

(52) U.S. Cl.
CPC ..... *F02M 25/0854* (2013.01); *F01M 13/023* (2013.01)

(58) Field of Classification Search
CPC .... F01M 13/023; F01M 13/04; F01M 13/022; F01M 13/00; F01M 13/0033; F01M 11/00; F02M 25/06; F02M 35/10222
USPC ..... 123/572–574
See application file for complete search history.

(56) References Cited

U.S. PATENT DOCUMENTS 2,652,819 A * 9/1953 Nusbaum ..... F01M 11/0408 123/41.86
3,145,697 A * 8/1964 Barr et al. ..... F01M 13/023 123/574
3,175,546 A * 3/1965 Roper ..... F01M 13/025 123/572
3,225,753 A * 12/1965 Bintz ..... F01M 13/023 123/574
3,585,976 A * 6/1971 Rider ..... F02M 23/08 123/327
3,645,242 A * 2/1972 Horiuchi ..... F01M 13/023 123/574
3,754,538 A * 8/1973 Ephraim, Jr. ..... F01M 13/04 123/198 D
4,056,085 A * 11/1977 Nowroski ..... F01M 13/023 123/574
4,136,650 A 1/1979 Manookian, Jr. ..... 123/119 B
4,269,607 A * 5/1981 Walker ..... B01D 45/00 123/573
4,308,841 A * 1/1982 Kingsley ..... F02M 25/0836 123/520
4,627,406 A 12/1986 Namiki et al. ..... 123/573
4,686,952 A * 8/1987 Zeigler, Jr. ..... F01M 13/023 123/572
4,856,487 A * 8/1989 Furuya ..... F01M 13/023 123/574
5,024,203 A 6/1991 Hill ..... 123/573
5,228,424 A * 7/1993 Collins ..... F01M 13/023 123/574
5,277,154 A * 1/1994 McDowell ..... B01D 45/06 123/41.86
5,562,087 A * 10/1996 Wright ..... F01M 13/04 123/572

(Continued)

*Primary Examiner* — Thomas Moulis
(74) *Attorney, Agent, or Firm* — MacCord Mason PLLC

(57) ABSTRACT

A method of removing oil from blowby vapors in an engine having a crankcase and an intake manifold includes filtering the blowby vapor from the engine crankcase to form a vapor depleted of oil and a collected oil. The vapor depleted of oil is communicated to the engine manifold. At high engine loads the collected oil is held in a chamber, and at low engine loads while the engine is still running, the collected oil is forced from the chamber back the crankcase.

19 Claims, 2 Drawing Sheets

(56) References Cited

U.S. PATENT DOCUMENTS 5,579,744 A * 12/1996 Trefz ..... F01M 13/0405 123/573
5,586,996 A 12/1996 Manookian, Jr. ..... 55/321
5,617,834 A * 4/1997 Lohr ..... F02B 75/22 123/572
5,697,349 A * 12/1997 Blum ..... F01M 13/023 123/572
5,803,025 A * 9/1998 Feucht ..... F01M 13/04 123/41.86
6,009,846 A * 1/2000 Walker, Jr. ..... F02M 35/024 123/198 E
6,024,058 A * 2/2000 Burnett ..... F01M 13/04 123/41.86
6,092,492 A * 7/2000 Kampichler ..... F01M 13/04 123/41.86
6,123,061 A 9/2000 Baker et al. ..... 123/573
6,279,555 B1 8/2001 Crowell et al. ..... 123/572
6,422,224 B1 * 7/2002 Walker, Jr. ..... F01M 13/04 123/572
6,435,170 B1 8/2002 Hamelink et al. ..... 123/572
6,802,303 B2 * 10/2004 H.ang.kansson .... F01M 13/022 123/574
7,007,682 B2 3/2006 Takahashi et al. ..... 123/572
7,080,636 B2 7/2006 Knaus et al. ..... 123/572
7,182,804 B2 2/2007 Gieseke et al. ..... 95/287
7,726,288 B2 * 6/2010 Chen ..... F02M 25/06 123/572
8,051,844 B2 * 11/2011 Clark ..... B01D 46/30 123/572
8,146,574 B2 * 4/2012 Heckel ..... F02M 25/06 123/198 E
8,404,014 B2 3/2013 Israel et al. ..... 55/385.3
8,449,637 B2 5/2013 Heinen et al. ..... 55/327
9,376,945 B2 6/2016 Wagner ..... F01M 13/023
2004/0069286 A1 * 4/2004 Knowles ..... F01M 13/022 123/572
2011/0290225 A1 12/2011 Torella ..... 123/573

* cited by examiner

VENT FOR ENGINE CRANKCASES

BACKGROUND OF THE INVENTION

The invention relates to a device to be included in a positive crankcase ventilation system for an internal combustion engine, particularly a high performance gasoline engine and/or a turbo-charged or otherwise boosted gasoline engine. In the operation of an internal combustion engine, inevitably some of the intake air and gasoline vapor passes between the piston and cylinder wall into the crankcase, called blowby gas. That vapor needs to be disposed of, and it is then normally with a positive crankcase ventilation system that feeds that vapor back to the fresh air engine intake. However, the crankcase also has oil in it, and bits of the oil can get mixed with the blowby vapors and carried up into the intake. That oil is deleterious when it is burned, causing early failure of other parts of the engine. Accordingly, it is important to remove oil from the blowby vapor that is being recirculated.

Oil in the combustion chamber will negatively affect performance and durability of an engine. It can, and most likely will, cause pre-ignition of the air fuel mixture. The venting promotes the capturing of oil and water vapor, thereby reducing the probability of oil in the combustion chamber.

Furthermore, not enough oil in the crankcase will affect the durability of the engine. Once the oil vapor or liquid has been captured into the venting system/tank, at the proper time, it is desirable for the oil to be returned to the crankcase within the engine. If this is not accomplished, a low oil condition will result in the engine. This will result in higher operating temperatures; lack of sufficient lubrication and, eventually, engine failure.

SUMMARY OF THE INVENTION

The present invention fulfills one or more of these needs in the art by providing an apparatus for removing oil from blowby vapors in an engine having a crankcase and an intake manifold. A canister has an inlet to receive blowby vapor from the engine crankcase, a filter and a port to discharge blowby vapor depleted of oil. A groove at the bottom of the canister collects oil draining from the filter and communicates with a compartment below the groove. A first valve is positioned in a wall of the compartment and leads into a chamber that has a movable wall that is resiliently urged to close the first valve when in a first position and allows the first valve to open when in a second position. The movable wall has a side opposite the first valve that communicates with a port to connect to the intake manifold so that side of the wall is exposed to the pressure at the intake manifold. A second, normally-closed valve that is opened when the movable wall is in the second position leads from the chamber to a disposal channel for oil and then to a port for connection to a return line to the crankcase. The filter directs oil from the blowby vapors to the bottom of the housing, and collected oil flows to the compartment above the first valve and passes into the chamber above the movable wall when the engine is at high load and therefore low vacuum which pulls the movable wall to the first position. When the engine load increases, the intake vacuum increases, so the movable wall moves to the second position, closing the first valve and opening the second valve and forcing oil which has accumulated above the movable wall to the disposal channel to be routed back to the crankcase.

In one embodiment the canister has a central opening into which the blowby vapors are introduced, a central perforated stem inside the canister so that the blowby vapor with oil can be directed radially outwardly within the canister, a coalescing filter in a cylindrical form radially outward of the stem and within the canister, and the discharge for the blowby vapor is at the top of the canister and radially outwardly from the coalescing filter.

The movable wall may include a plate on a diaphragm on one side of the chamber. The movable wall may be resiliently urged to the first position by a spring. Preferably, the filter is a coalescing filter.

The first and second valves may be configured identically as discs, each having a central protrusion on one disc side forming a valve stem. The second valve is opened when the movable wall pushes the valve stem of the second valve. In an embodiment the second valve is normally closed by gravity.

The invention includes the combination of such an oil separator and the engine for which it is useful.

The invention can also be considered as a method of removing oil from blowby vapors in an engine having a crankcase and an intake manifold. The method includes filtering the blowby vapor from the engine crankcase to form a vapor depleted of oil and a collected oil, directing the vapor depleted of oil to the engine manifold. At high engine loads the collected oil is held in a chamber, and at low engine loads while the engine is still running, the collected oil is forced from the chamber back the crankcase.

Holding the collected oil in a chamber may include allowing the collected oil to flow past an open first valve to the chamber and be held against further flow by a closed second valve. The first valve may be allowed to stay open by a low vacuum on the chamber side of the first valve when the engine is at high load.

Forcing the collected oil from the chamber back the crankcase may include closing the first valve and opening the second valve to open a drain line to the crankcase. It may also include compressing the chamber to force the oil past the second valve.

Filtering preferably includes passing the blowby vapor radially outward through an annular filter, particularly a coalescing filter.

Filtering the blowby vapor from the engine crankcase to form a vapor depleted of oil and collected oil can conveniently include allowing the collected oil to flow under the influence of gravity to a chamber.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
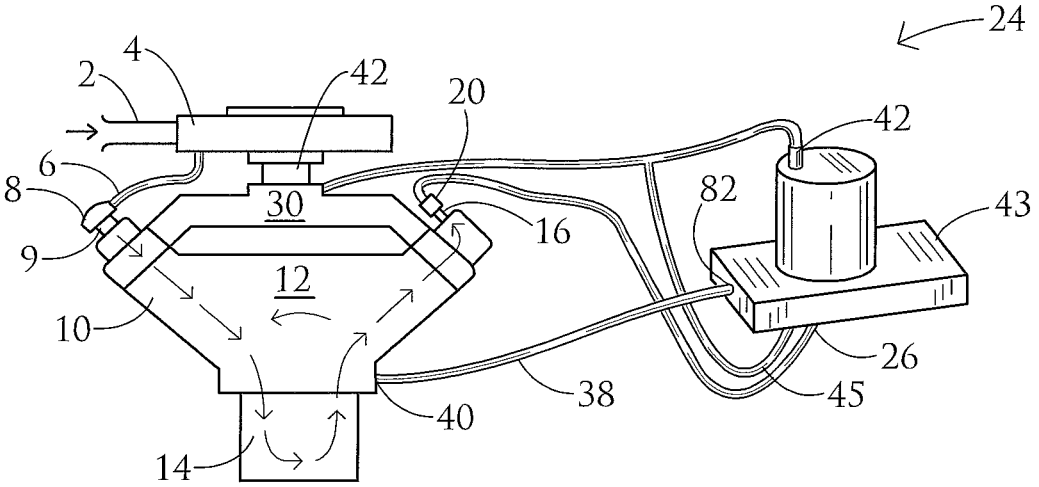
FIG. 1 is a schematic showing of a typical V-type engine incorporating an embodiment of the filter apparatus of the present invention.

FIG. 1 shows a partial cross-section of a typical V-type gasoline-powered engine embodying the present invention.

Air flows into the air filter 4 through the intake duct 2. Some of this air is directed via a conduit 6 through an engine aperture 9 to the interior 12 of the engine block 10, passing first through a breather cap 8. An oil pan 14 holds a volume of lubricating oil that is circulated throughout engine interior, or crankcase, 12. As the engine runs, the lubricating oil heats and emits oil vapors, which are trapped in crankcase 12. As shown by the arrows in FIG. 1, fresh air entering crankcase 12 at aperture 9 circulates therein, mixing with the trapped vapors, exiting engine block 10 at an aperture 16, and passing thence through positive crankcase ventilating (PCV) valve 20. The direction of flow is defined by a vacuum present in the intake manifold 30 whenever the engine is running, which vacuum pulls the air through the system. The mixture of air and crankcase vapors is channeled via a conduit 22 from PCV valve 20 to inlet port 44 of oil recovery filter 24.

Figure 2:
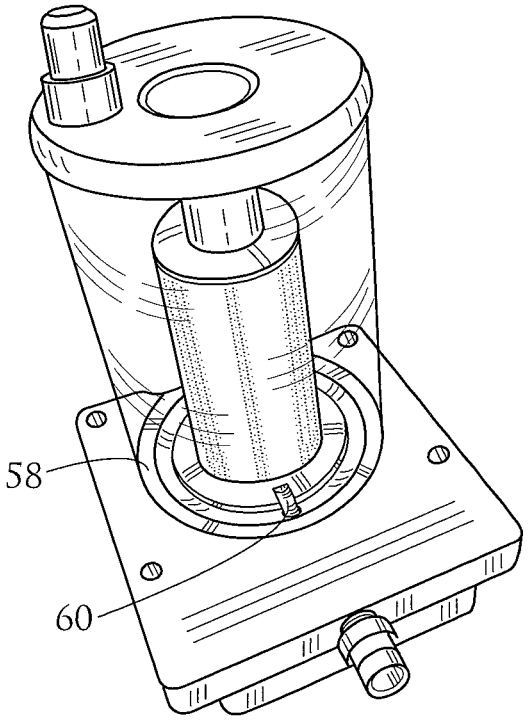
FIG. 2 is a top perspective view of a typical filter apparatus.
Figure 3:
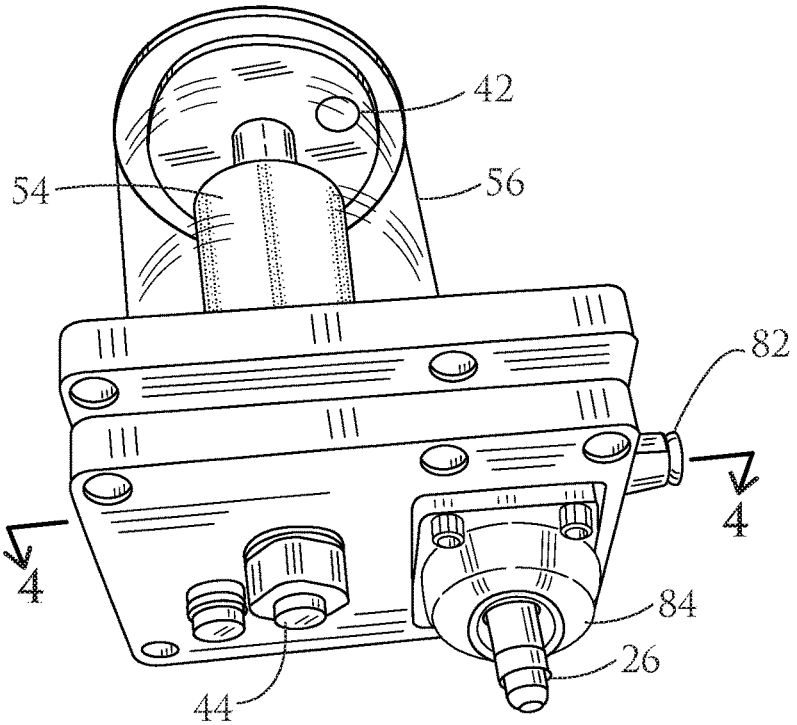
FIG. 3 is a lower perspective view of a typical filter apparatus.
Figure 4:
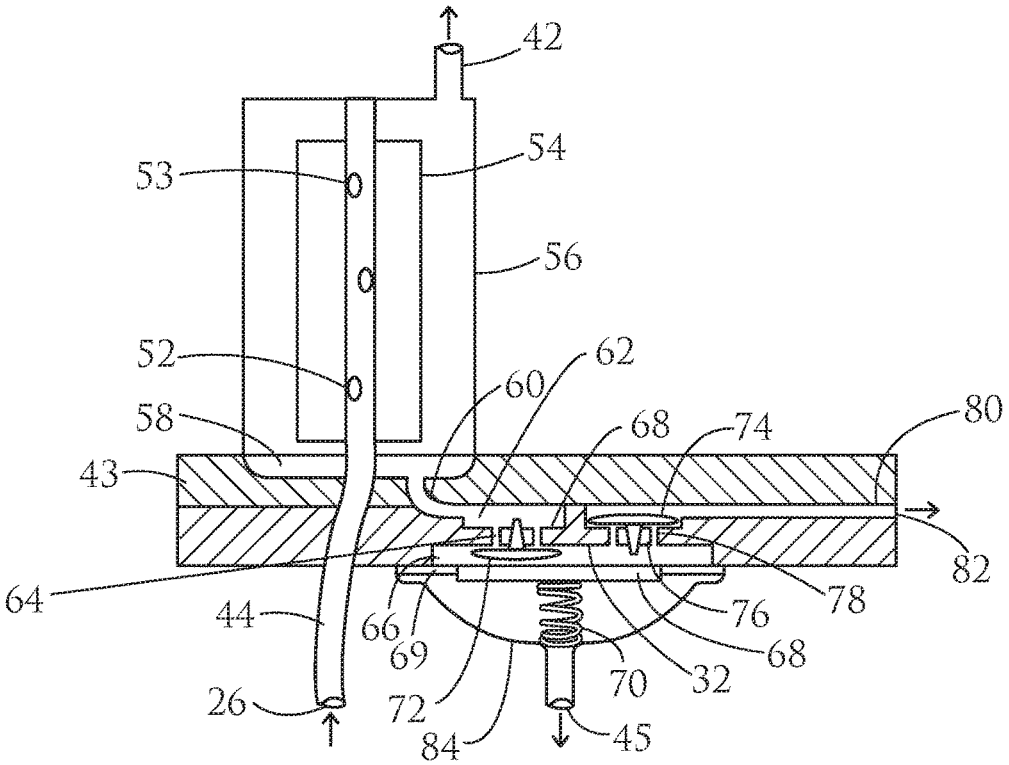
FIG. 4 is a vertical cross-section of a typical filter apparatus taken along lines 3-3 of FIG. 3 and looking in the direction of the arrows.

FIGS. 2, 3 and 4 show a preferred embodiment of a filter apparatus. A canister 56 has a central opening 44 in its base into which the blowby vapors are introduced. A central stem 52 inside the canister has a number of perforations 53 in it so that the vapor and oil mist can be directed radially outwardly within the canister. After a slight spacing, the vapor and mist encounter a coalescing filter 54 in a cylindrical form. The coalescing filter causes the fine droplets of oil to coalesce to the point where they no longer are carried in the blowby vapor stream and instead are allowed to flow by gravity downwardly to the bottom of the canister 56. The blowby vapor depleted of oil exits the top of the canister through an outlet 42 that is located near the top and offset outwardly from the coalescing filter.

A base 43 at the bottom of the canister has a groove 58 (See FIG. 2) which leads to a channel 60 that extends downward to a compartment 62 in the bottom of the canister. A valve 72 is located at the bottom of that compartment 62 to lead into a larger chamber 66 closed at its bottom by a movable plate 68 sealed around its periphery by a diaphragm 69. The valve 72 can selectively cover or uncover passageways 64, depending on the valve's position. The bottom of the plate 68 is urged upward by a spring 70, and the volume 84 on the spring side of the plate is exposed to the pressure at the intake manifold 44 by inlet 45. As used herein, the term "manifold" can include similar parts that supply the intake air to the cylinders of the engine, including turbochargers, supercharger or other booster for the engine. Above the plate 68, a second valve 74 that is normally closed by gravity opens upward to an outward disposal channel 80 for oil when the plate is urged upward by the spring 70 and contacts it. The spring is selected to have a specifications to operate in this fashion, and is typically a compression coil spring. Alternately, an extension spring could be used, located above the plate 68. The two valves 72 and 74 can be configured identically, each as disc with a central protruding valve stem. When the plate 68 rises, it contacts the valve stem of the valve 74 forcing it open and clearing passageways 78. The valve stem of the valve 72 primarily helps keep the disc's movement aligned with the communication passageways 64

In operation, the oil removed from the blowby gas by the filter 54 drains to the compartment 62 above the first valve 72 but flows through the passageways 64 into the chamber 66 above the plate 68 when the engine is at low load and therefore high vacuum. When the engine load increases, the intake vacuum at 45 decreases, which allows the diaphragm plate 68 to move upwardly, closing the valve 72 draining from the canister and opening the second valve 74 to allow the oil which has accumulated in the chamber 66 above the plate 68 to divert outwardly to the oil drain 80 to be routed back to the crankcase.

The air entering the canister is drawn into a filter 54 that separates fine oil droplets from the air before the air returns to the engine through outlet 42. As the filter is saturated, it reduces the air flow based on mass on the filter media. This causes the vacuum from the engine to increase in the device and air flow reduces when the engine is producing the most power.

The oil collected on the filter 54 falls into the bottom of the cavity where it is picked up by the vacuum driven pump (i.e. the combined action of the valves, chamber and diaphragm plate) that returns the captured oil to the engine. This pump uses selected spring pressure balanced against changing vacuum during engine operation to drive the diaphragm in the base of the device repeatedly in and out. This action causes oil to move past the device's valves and forces it back into the crankcase of the engine. When it is time to return the collected oil to the crankcase, the arrangement of the pressures on the valves not only open the valves, but also provides a vacuum to pull the oil downward for the return path to the crankcase. Thus the system does not have to rely on gravity.

The oil collected at the bottom of the canister is continually pumped back to the crankcase as the load on the engine varies, preventing large oil accumulations. That is, when a vehicle driver or other engine operator changes the load, such as by shifting gears, or changing from acceleration to coasting or deceleration, the vacuum levels change, to force collected oil back toward the crankcase.

The following table shows the valve positions at various engine loads:

| Engine load | Pressure at 45 (blowby connection to the crankcase) | Pressure at 42 (outlet to manifold) | Pressure at 26 (oil return to the crankcase) | Valve 50 (open or closed?) | Valve 32 (open or closed?) |
|---|---|---|---|---|---|
| High | 0-1 psi positive | 0-1 negative | 0 | Closed | Open |
| Low | 0 | 8-10 negative These low values will rise as filter fouls with oil, and reduce when the filter clears oil | 12-20 negative Car deceleration will increase the negative value | Open | Closed Both valves will be neutral when the diaphragm has no action. |

The valving that returns the collected oil to the crankcase is important to a user, and eliminates one more thing that can be forgotten, when operating a race engine over an extended period of time. Not having to remember to drain the vent oil collector has value, in view of the possible performance/safety outcomes that will result if a conventional collector is not emptied when it is full.

The coalescing filter to separate the oil from the moisture/water is a preferred structure, but other filters can be used.

Other filter geometries may also prove useful in the practice of the invention, such as a flow radially inward as taught by U.S. Pat. No. 8,449,637 to Heinen et al, or through a more planer filter material as taught by U.S. Pat. No. 4,627,406 to Namiki et al., or radially outward through a horizontal axis, as taught by U.S. Pat. No. 5,697,349 to Blum. The disclosures of these references are hereby incorporated herein by reference. The corresponding canister design has the groove to collect oil located at a position where oil on the filter can drain, and a an oil drain path and pumping mechanism adapted to the revised geometry. This may result in the valves being mounted for movement along a horizontal path, but can be constrained by springs or other valve actuator.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for removing oil from blowby vapors in an engine having a crank case and an intake manifold comprising a canister having a base, an inlet for blowby vapor from the engine crankcase, a filter and a discharge for blowby vapor depleted of oil, a groove in the base within the canister to collect oil draining from the filter in communication with a compartment below the groove, a first valve in a wall of the compartment leading into a chamber having a movable wall that is resiliently urged to close the first valve when in a first position and allows the first valve to open when in a second position, the movable wall having a side opposite the first valve communicating with a port to connect to the pressure at the intake manifold, a second, normally-closed valve that is opened when the movable wall is in the second position and leading from the chamber to a disposal channel for oil, the disposal channel having a port for connection to a return line to the crankcase, whereby the filter directs oil from the blowby vapors to the bottom of the housing and collected oil flows to the compartment above the first valve and passes into the chamber above the movable wall when the engine is at high load and therefore low vacuum and when the engine load decreases, the intake vacuum increases, so the movable wall moves to the second position, closing the first valve and opening the second valve and forcing oil which has accumulated above the movable wall to the disposal channel to be routed back to the crankcase.

2. An apparatus as claimed in claim 1 wherein the base of the canister has a central opening into which the blowby vapors are introduced, the canister has a central perforated stem inside the canister so that the blowby vapor with oil can be directed radially outwardly within the canister, a coalescing filter in a cylindrical form radially outward of the stem and within the canister, and the discharge for the blowby vapor is at the top of the canister and radially outwardly from the coalescing filter.

3. An apparatus as claimed in claim 1 wherein the movable wall includes a plate on a diaphragm on one side of the chamber.

4. An apparatus as claimed in claim 1 wherein the movable wall is resiliently urged to the first position by a spring.

5. An apparatus as claimed in claim 1 wherein the filter is a coalescing filter.

6. An apparatus as claimed in claim 1 wherein the first and second valves are configured identically as discs with central protrusion on one disc side forming a valve stem.

7. An apparatus as claimed in claim 6 wherein the second valve is opened when the movable wall pushes the valve stem of the second valve.

8. An apparatus as claimed in claim 1 wherein the second valve is normally closed by gravity.

9. An internal combustion engine having a crankcase and an intake manifold including an apparatus for removing oil from blowby vapors in the crankcase comprising a canister having an inlet for blowby vapor from the engine crankcase, a filter and a discharge for blowby vapor depleted of oil, the canister having a base, a groove in the base within the canister to collect oil draining from the filter in communication with a compartment below the groove, a first valve in a wall of the compartment leading into a chamber having a movable wall that is resiliently urged to close the first valve when in a first position and allows the first valve to open when in a second position, the movable wall having a side opposite the first valve communicating with a port to connect to the pressure at the intake manifold, a second, normally-closed valve that is opened when the movable wall is in the second position and leading from the chamber to a disposal channel for oil, the disposal channel having a port for connection to a return line to the crankcase, whereby the filter directs oil from the blowby vapors to the bottom of the housing and collected oil flows to the compartment above the first valve and passes into the chamber above the movable wall when the engine is at high load and therefore low vacuum and when the engine load decreases, the intake vacuum increases, so the movable wall moves to the second position, closing the first valve and opening the second valve and forcing oil which has accumulated above the movable wall to the outward disposal channel to be routed back to the crankcase.

10. An apparatus for removing oil from blowby vapors comprising a canister with a central opening into which the blowby vapors are introduced, a central stem inside the canister having perforations in it so that the vapor and oil mist can be directed radially outwardly within the canister, a coalescing filter in a cylindrical form radially outward of the stem and within the canister, a discharge port for the blowby vapor at the top of the canister and offset outwardly from the coalescing filter, a groove at the bottom of the canister, leading to a channel that extends downward to a compartment in the bottom of the canister, a valve at the bottom of the compartment leading into a larger chamber defined at its bottom by a movable plate sealed around its periphery by a diaphragm, a spring at the bottom of the plate urging the plate upward with and the volume on the spring side of the plate having a port to connect to the pressure at the intake manifold, and a second valve that is normally closed by gravity on the top of the plate, positioned to open upward to an outward disposal channel for oil when the plate contacts it, the disposal channel having a port for connection to a return line to the crankcase, whereby the coalescing filter causes the fine droplets of oil to coalesce to the point where they no longer are carried in the blowby vapor stream and instead are allowed to flow by gravity downwardly to the bottom of the canister and collected oil can collect in the compartment above the first valve but trickles down into the volume above the plate when the engine is at high load and therefore low vacuum and when the engine load decreases, the intake vacuum increases, allowing the diaphragm to rise upwardly, closing the valve draining from the canister and opening the second valve to allow the oil which has accumulated above the plate to divert outwardly to the oil drain to be routed back to the crankcase.

11. A method of removing oil from blowby vapors in an engine having a crankcase and an intake manifold comprising filtering the blowby vapor from the engine crankcase to form a vapor depleted of oil and a collected oil, directing the vapor depleted of oil to the engine manifold, and at high engine loads holding the collected oil in a chamber, and at low engine loads while the engine is still running, forcing the collected oil from the chamber back the crankcase.

12. A method as claimed in claim 11 wherein holding the collected oil in a chamber includes allowing the collected oil to flow past an open first valve to the chamber and to be held against further flow by a closed second valve.

13. A method as claimed in claim 12 wherein the first valve is allowed to stay open by a plate on the chamber side of the first valve when the engine is at high load and therefore low vacuum.

14. A method as claimed in claim 12 wherein forcing the collected oil from the chamber back the crankcase includes closing the first valve and opening the second valve to open a drain line to the crankcase.

15. A method as claimed in claim 14 wherein forcing the collected oil includes compressing the chamber to force the oil past the second valve.

16. A method as claimed in claim 11 wherein filtering includes passing the blowby vapor radially outward through an annular filter.

17. A method as claimed in claim 11 wherein filtering includes passing the blowby vapor radially outward through an annular coalescing filter.

18. A method as claimed in claim 11 wherein filtering the blowby vapor from the engine crankcase to form a vapor depleted of oil and collected oil includes allowing the collected oil to flow to the chamber under the influence of gravity.

19. A method of removing oil from blowby vapors in an engine having a crankcase and an intake manifold comprising filtering the blowby vapor from the engine crankcase to form a vapor depleted of oil and a collected oil, directing the vapor depleted of oil to the engine manifold, wherein filtering includes passing the blowby vapor radially outward through an annular coalescing filter and allowing the collected oil to flow under the influence of gravity to a chamber, at high engine loads, holding the collected oil in the chamber including allowing the collected oil to flow past an open first valve to the chamber and be held against further flow by a closed second valve, wherein the first valve is allowed to stay open by a plate on the chamber side of the first valve when the engine is at high load and therefore low vacuum, and at low engine loads while the engine is still running, forcing the collected oil from the chamber back toward the crankcase by closing the first valve and opening the second valve to open drain line to the crankcase and compressing the chamber to force the oil past the second valve.

* * * * *